US006918189B1

(12) United States Patent
McBrayer

(10) Patent No.: US 6,918,189 B1
(45) Date of Patent: Jul. 19, 2005

(54) COMBINATION LAYOUT TOOL

(76) Inventor: Keith McBrayer, 662 Tolman Creek Rd., Ashland, OR (US) 97520

( * ) Notice: Subject to any disclaimer, the term of this patent is extended or adjusted under 35 U.S.C. 154(b) by 168 days.

(21) Appl. No.: 09/982,302

(22) Filed: Oct. 17, 2001

Related U.S. Application Data

(60) Provisional application No. 60/243,228, filed on Oct. 25, 2000.

(51) Int. Cl.[7] ..... B43L 7/00

(52) U.S. Cl. ..... 33/566; 33/1 G; 33/482; 33/562

(58) Field of Search ..... 33/1 R, 482, 562, 33/563, 566, 1 G, 613, 645, 32.2, 486, 487, 492, 494, 29, 416, 417, 420, 421, 565, 476

(56) References Cited

U.S. PATENT DOCUMENTS

| | | | | | |
|---|---|---|---|---|---|
| 306,869 | A | * | 10/1884 | McMasters | 33/474 |
| 364,508 | A | * | 6/1887 | Griffiths | 33/482 |
| 855,987 | A | * | 6/1907 | Schlageter | 33/474 |
| 1,050,969 | A | * | 1/1913 | McLeod | 33/420 |
| 1,295,041 | A | * | 2/1919 | Kekuewa | 33/476 |
| 1,315,333 | A | * | 9/1919 | Roads | 33/476 |
| 1,579,137 | A | * | 3/1926 | Pecker | 33/476 |
| 1,600,666 | A | * | 9/1926 | Dugan | 33/482 |
| 1,619,427 | A | * | 3/1927 | McCaffery, Jr. | 33/476 |
| 1,699,619 | A | * | 1/1929 | Muench | 33/476 |
| 1,751,366 | A | * | 3/1930 | Shaub | 33/476 |
| 1,980,765 | A | * | 11/1934 | Sloper | 33/417 |
| 1,995,204 | A | * | 3/1935 | Ford | 33/476 |
| 2,016,489 | A | * | 10/1935 | Escalante | 33/476 |
| 2,039,333 | A | * | 5/1936 | Musham | 33/1 R |
| 2,532,329 | A | * | 12/1950 | Premo | 33/474 |
| D161,570 | S | * | 1/1951 | Campbell | D10/62 |
| 2,556,781 | A | * | 6/1951 | Smithson | 33/482 |
| D163,850 | S | * | 7/1951 | Campbell | D10/62 |
| 2,579,857 | A | * | 12/1951 | Premo | 33/476 |
| 2,589,525 | A | * | 3/1952 | Absher | 33/423 |
| 2,593,914 | A | * | 4/1952 | Palitto | 33/482 |
| 2,631,376 | A | * | 3/1953 | Callahan | 33/424 |
| 2,637,110 | A | * | 5/1953 | Gilbertson | 33/476 |
| 4,345,383 | A | * | 8/1982 | Corsette | 33/482 |
| 4,461,092 | A | * | 7/1984 | Hore | 33/474 |
| 4,490,916 | A | * | 1/1985 | Blum | 33/474 |
| 4,598,482 | A | * | 7/1986 | Castleton | 33/565 |
| 4,974,330 | A | * | 12/1990 | Covert | 33/474 |
| 5,090,129 | A | * | 2/1992 | Cunningham | 33/481 |
| 5,170,568 | A | * | 12/1992 | Wright | 33/480 |
| 5,239,762 | A | * | 8/1993 | Grizzell | 33/474 |
| 5,727,325 | A | * | 3/1998 | Mussell | 33/429 |
| 5,943,974 | A | * | 8/1999 | Hoag | 112/475.01 |
| 6,314,652 | B1 | * | 11/2001 | English | 33/421 |
| 6,505,412 | B2 | * | 1/2003 | Hauzie, Jr. | 33/529 |
| 6,553,678 | B1 | * | 4/2003 | Austin | 33/482 |
| 2002/0133961 | A1 | * | 9/2002 | Tomiser et al. | 33/534 |

* cited by examiner

*Primary Examiner*—Diego Gutierrez
*Assistant Examiner*—Amy R. Cohen
(74) *Attorney, Agent, or Firm*—Renner, Otto, Boisselle & Sklar, LLP

(57) ABSTRACT

A combination layout tool especially for use in larger building projects that can be used repeatedly to accurately produce different angles and cuts or layouts. The tool is provided with incremental angle slots in radial alignment with a notch in one side edge for producing incremental angles, one or more rafter tail/ridgecut patterns in the side edge, angled slots in alignment with the short side of the patterns, tread and riser slots and an associated tread and riser hole in spaced relation from one another for laying out treads and risers for building stairs, a pivot point receiving hole and a plurality of incrementally spaced marker receiving holes for drawing different diameter circles, and/or one or more stud layout slots in the side edge for making stud layouts for framed walls.

20 Claims, 6 Drawing Sheets

COMBINATION LAYOUT TOOL

CROSS-REFERENCE TO RELATED APPLICATIONS

This application claims the benefit of U.S. Provisional Application Ser. No. 60/243,228, filed Oct. 25, 2000.

FIELD OF THE INVENTION

This invention is for a combination layout tool that incorporates a number of features that can be used by woodworkers and other craftspeople, including novices and professionals, in crafting the details needed to accomplish a multitude of building projects.

BACKGROUND OF THE INVENTION

Heretofore, the only layout tools that were available in the marketplace to woodworkers and other craftspeople in crafting the details needed to accomplish a multitude of building projects were small 45° squares and larger adjustable squares that were not very accurate.

SUMMARY OF THE INVENTION

The layout tool of the present invention provides a permanent pattern especially for use on larger building projects that can be used repeatedly to accurately produce different angles and cuts or layouts.

In accordance with one aspect of the invention, the layout tool of the present invention provides an accurate way of producing certain angles for larger projects, for example, 22½°, 45° and 67½° angles across 24 inch wide projects.

In accordance with another aspect of the invention, the layout tool can be used to accurately create incremental angles.

In accordance with another aspect of the invention, the layout tool can be used for automatic layout of rafter tails, birdsmouth cuts and/or ridgecuts having a pitch for example of 4 and 12 pitch and/or 6 and 12 pitch.

In accordance with another aspect of the invention, the layout tool can be used to effortlessly lay out stairs having for example a 10 inch tread and a 7 inch riser for a 2×12 inch stringer.

In accordance with another aspect of the invention, the layout tool can be used to produce different stud layouts on different centers, for example, 16 and/or 24 inch centers.

In accordance with another aspect of the invention, the layout tool can be used to accurately create large circles having a diameter for example of between 2 inches and 54 inches in increments for example of 2 inches.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
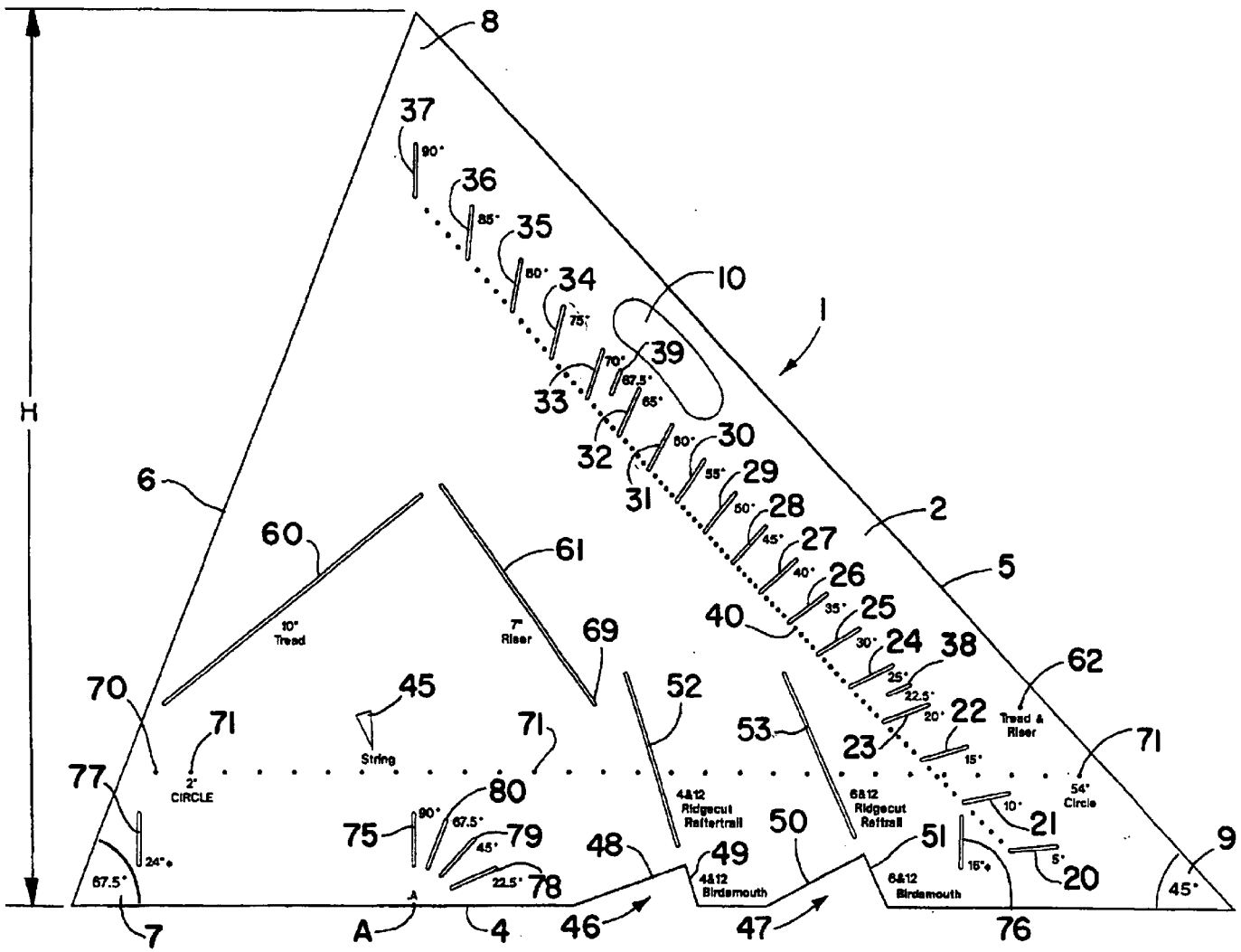
FIG. 1 is a plan view of one form of layout tool in accordance with the present invention.

Referring now in detail to the drawings, and initially to FIG. 1, there is shown one form of combination layout tool 1 in accordance with this invention comprising a triangular shaped member 2 having three side edges 4–6 that intersect at opposite ends to form three corners 7–9. The tool 1 may be made out of a relatively rigid lightweight material such as plastic. In the embodiment shown in FIG. 1, the layout tool has two 67½° angle corners 7, 8 and one 45° corner 9. Also, the layout tool has a perpendicular height H from either 67½° angle corner 7, 8 to the respective opposite side edge 4, 5 of approximately 24 inches. Adjacent one side edge of the tool is an arcuate finger slot 9 to facilitate grasping with one hand for ease of handling.

Figure 2A:
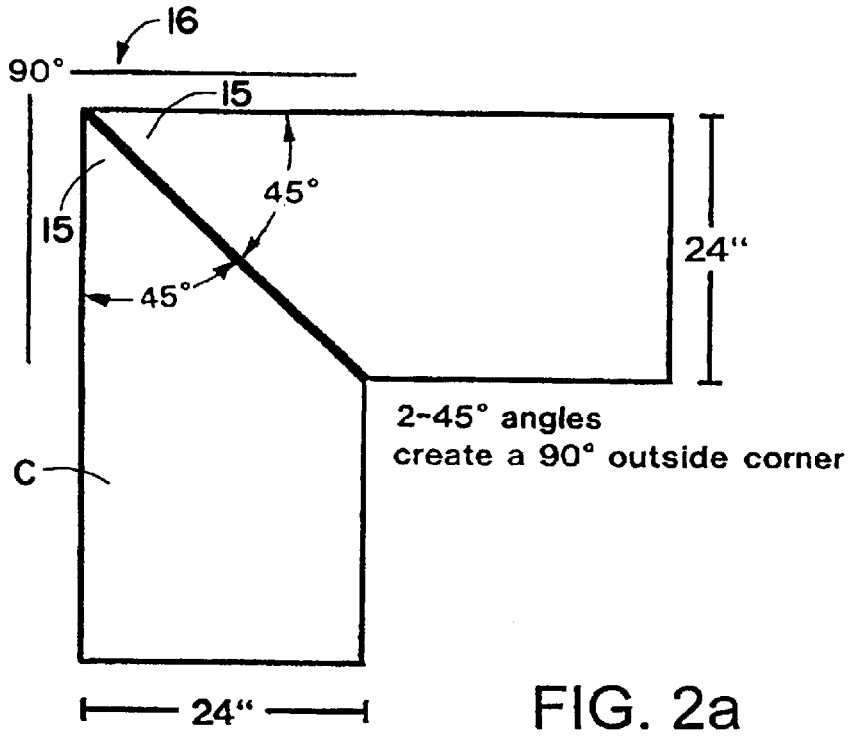
FIG. 2*a* is a schematic plan view of a 24 inch deep countertop having two 45° miter joints.
Figure 2B:
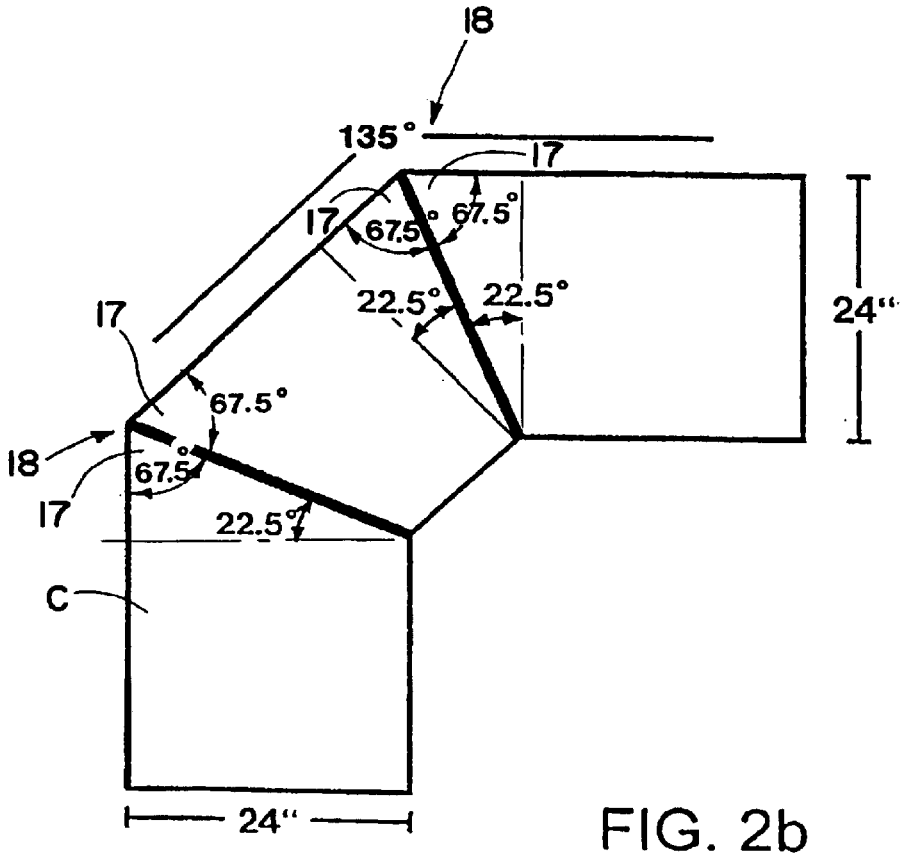
FIG. 2*b* is a plan view of a 24 inch deep countertop having four 67½° miter joints, each of which has a complementary angle of 22½° off the perpendicular.

Such a tool can be used, for example, to accurately produce two 45° miter joints 15 to create a 90° outside corner 16 in a 24 inch deep countertop C as schematically shown in FIG. 2*a*. Also, such a tool can be used, for example, to accurately produce two or more 67½° miter joints 17 in a 24 inch deep countertop C to create 135° outside corners 18 as schematically shown in FIG. 2*b*. The complement to such 67½° angles off the perpendicular is 22½° as further schematically shown in FIG. 2*b*. From this it will be apparent that the tool 1 can be used to create the exact angle desired to complete the miter. Moreover, the tool 1 with this angle layout can be used to align a straight edge, facilitating the cutting process when using a skill saw or router.

Referring further to FIG. 1, one of the side edges 4 of the tool extending between the 45° angle and one of the 67½° angles is used as the base line of the tool. This side edge 4 has a notch A closer to the 67½° angle corner 7 than the 45° angle corner 9. In the embodiment disclosed herein, the notch A is actually somewhat closer to the 67½° angle corner 7 than the intersection of a line extending perpendicular from the other 67½° angle corner 8 with the base line side edge 4. Adjacent the side edge 5 opposite the 67½° angle corner 7 are a plurality of incremental angle slots 20–37 in radial alignment with notch A. These incremental angle slots are incrementally spaced apart at incremental angles, for example, of 5°, from 0° as measured from notch A in a direction away from side edge 4 of the tool up to 90° at angle slot 37 which is perpendicular to side edge 4 and in alignment with notch A. Also, additional incremental angle slots may be provided between selected pairs of 5° angle slots, for example, one slot 38 at 22½° as measured from notch A in a direction away from side edge 4, and another incremental angle slot 39 at 67½° as measured from notch A in a direction away from side edge 4. In addition, incremental holes 40, each incrementally spaced 1° apart, may be provided between the 5° angle slots 20–36 as further shown in FIG. 1.

The tool 1 with such incremental angle slots/holes may be used to create virtually any angle from 0 to 90° by placing a pencil mark at notch A of tool 1 and a second mark in any one of the incremental slots 20–39 or holes 40 in angled spaced relation to notch A and connecting the two marks by drawing a continuous line along one of the straight side edges 5 or 6 of the tool.

Figure 3:
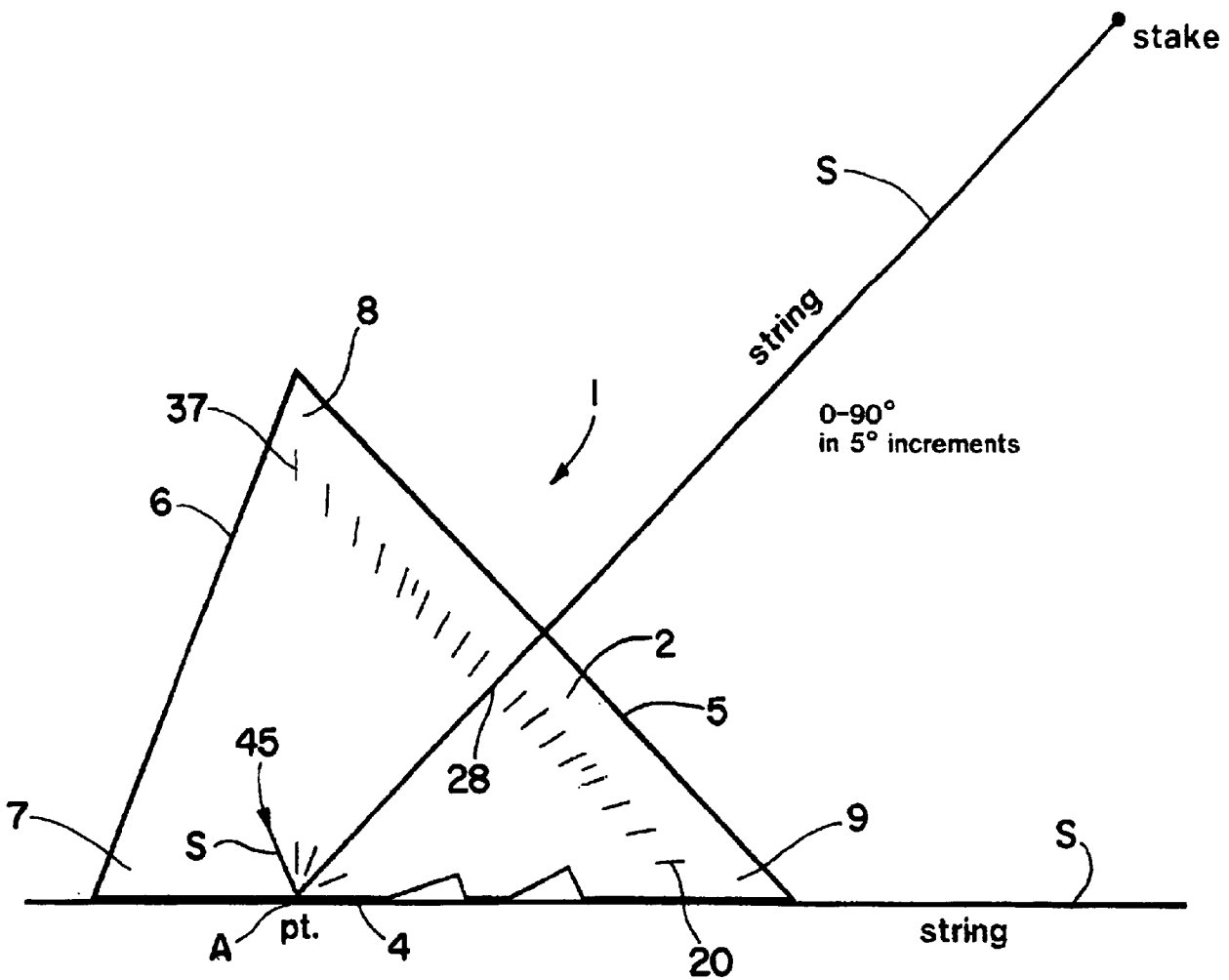
FIG. 3 is a schematic plan view showing the layout tool being used to accurately create incremental angles from 0° to 90°.

In addition, tool 1 may be used in locating angles, for example up to 50 feet in length, with reasonable accuracy by pulling a string S over the desired angle, for example the 45° angle slot 28 and then over the notch A, and latching the string up through a triangular slot 45 in tool 1 adjacent notch A as schematically shown in FIGS. 1 and 3. This process is especially helpful in creating the perimeter of decks, fences or foundations.

One or more rafter tails/ridge cut patterns may also be formed in the base line side edge 4 of tool 1 in spaced relation from notch A. In the embodiment shown in FIG. 1, two such rafter tail/ridge cut patterns 46 and 47 are provided in such side edge. One of the patterns 46 may for example be a 4 and 12 pitch pattern, whereas the other pattern 47 may for example be a 6 and 12 pitch pattern. Each of the patterns 46, 47 is formed by two straight sides 48, 49 and 50, 51, respectively, intersecting side edge 4 and also intersecting one another at a 90° angle. One of the sides 49, 51 of each pattern 46, 47 is shorter than the other side 48, 50. Also angled slots 52 and 53 are provided in tool 1 in alignment with the respective short sides 49 and 51 of the patterns 46 and 47.

Figure 4:
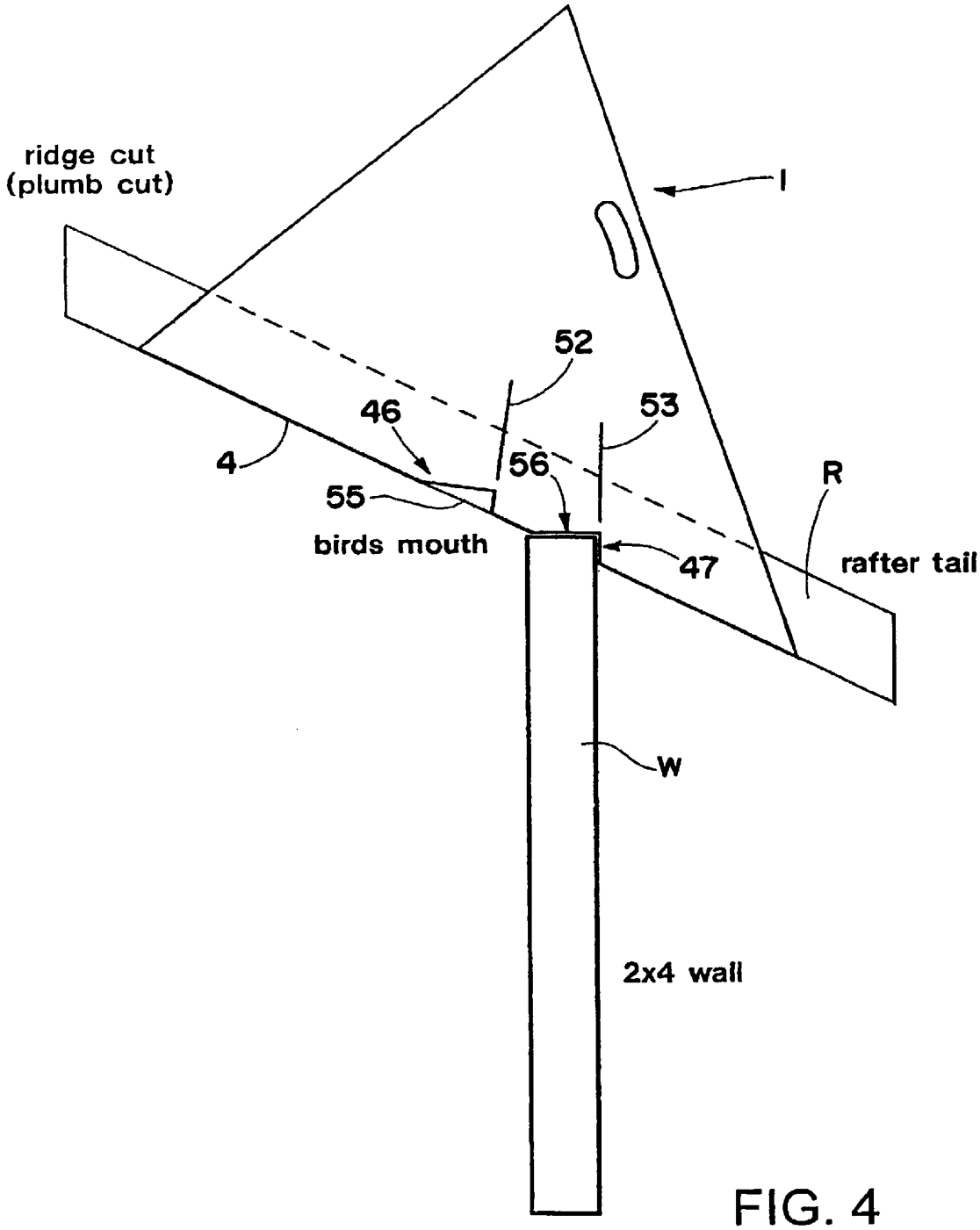
FIG. 4 is a schematic plan view showing the layout tool being used to mark a pattern for a birdsmouth cut in a rafter to allow the rafter to seat securely on top of a framed wall.

To make these angles, the side edge 4 of tool 1 is placed flush with the bottom edge 55 of a rafter R as schematically shown in FIG. 4. The desired pre-marked rafter tail/ridge cut slot angle 52 or 53 is used to achieve the correct angle for a 4 and 12 pitch or 6 and 12 pitch angle, by pencil marking at the matching points for the correct pitch. The pattern for this cut is made by marking the pattern 46 or 47 which is already aligned with the desired rafter tail mark 52 or 53. The birdsmouth cut 56 is made in the bottom edge 55 of the rafter R to allow the rafter to seat securely on top of a framed wall W as further schematically shown in FIG. 4.

Tread and riser slots 60 and 61 may also be provided in tool 1 for making a perfect tread and riser for use in building stairs. These tread and riser slots 60 and 61 extend at 90° relative to one another, with their inner ends terminating in closely spaced relation from one another and their outer ends terminating in a plane parallel to the side edge 4 of the tool as schematically shown in FIG. 1. The tread slot 60 may have a length, for example, of 10 inches, and the riser slot 61 may have a length, for example, of 7 inches. Also, a tread and riser hole 62 is provided in tool 1 in the same plane as the outer ends of the tread and riser slots 60 and 61. Hole 62 is spaced from the outer end 69 of riser slot 61 a distance corresponding to the distance between the outer ends of the tread and riser slots 60 and 61.

Figure 5:
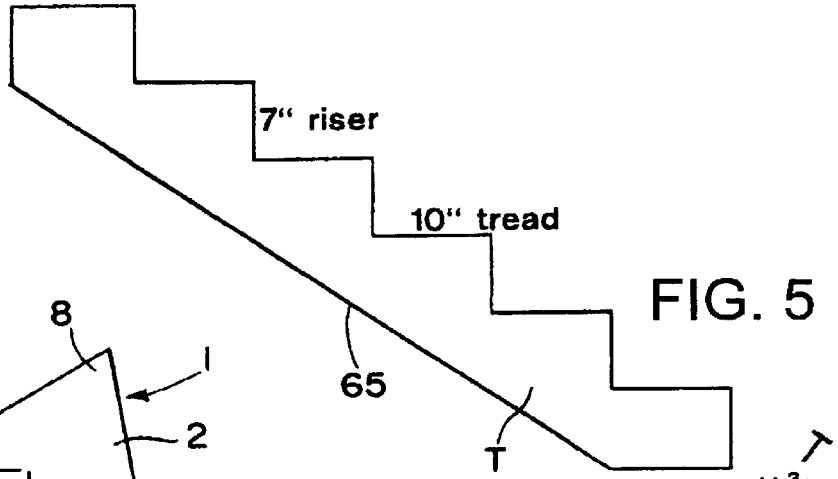
FIG. 5 is a schematic side elevation view showing a stringer with treads and risers cut therein for use in building stairs.
Figure 5A:
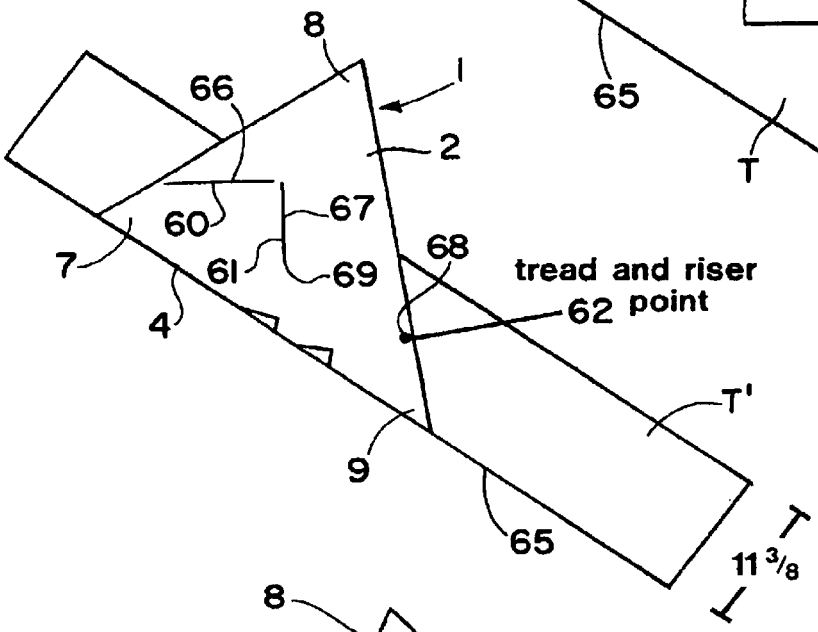
FIG. 5*a* is a schematic view showing the layout tool being used to lay out the treads and risers on a stringer to make the tread and riser stringer shown in FIG. 5.

To make a perfect tread and riser stringer T of the type schematically shown in FIG. 5, the base line side edge 4 of tool 1 is positioned along the bottom side 65 of an uncut stringer T' as schematically shown in FIG. 5*a*. Pencil lines 66 and 67 are then drawn in the tread and riser slots 60 and 61 and a pencil dot 68 is placed in the tread and riser hole 62 as further shown in FIG. 5*a*. Next the tool 1 is slid along the stringer T' toward the right as depicted in FIG. 5*a* until the pencil dot 68 from the tread and riser hole 62 is aligned with the bottom edge 69 of the riser slot 61. When thus positioned, a second set of pencil lines can be drawn in the tread and riser slots 60 and 61, followed by another pencil dot 68 in the tread and riser hole 62. Repeating this process will accomplish the complete pattern on the tread and riser stringer for building stairs.

Figure 6:
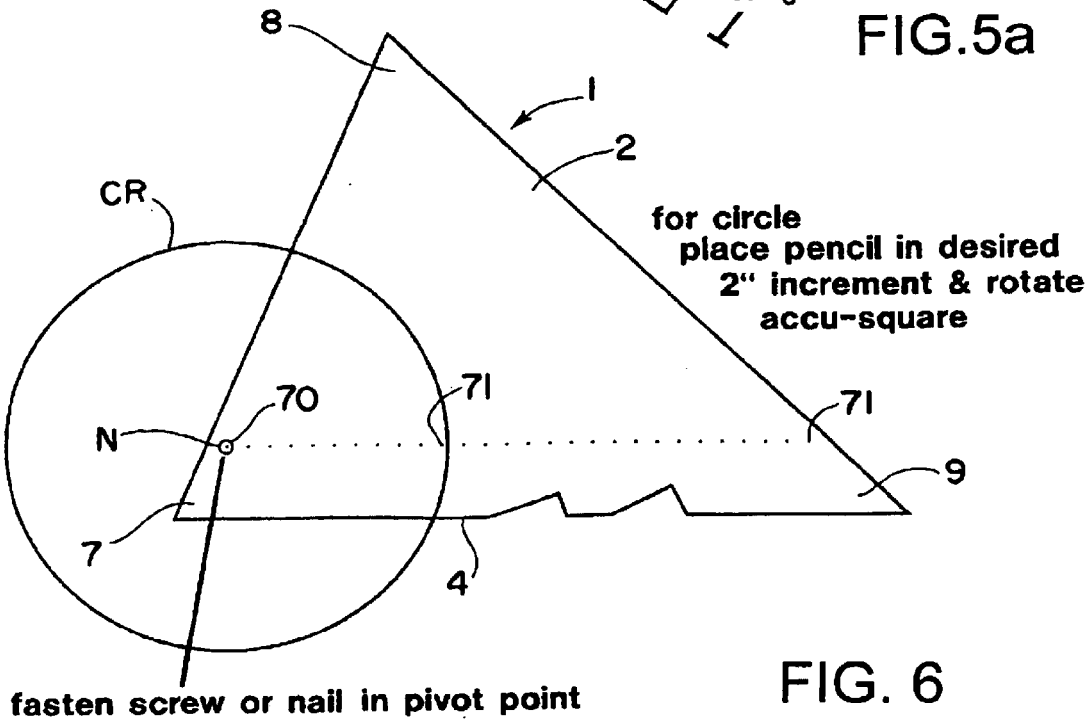
FIG. 6 is a schematic plan view showing the layout tool being used to accurately create circles having a diameter for example of between 2 inches and 54 inches in increments for example of 2 inches.
Figure 8:
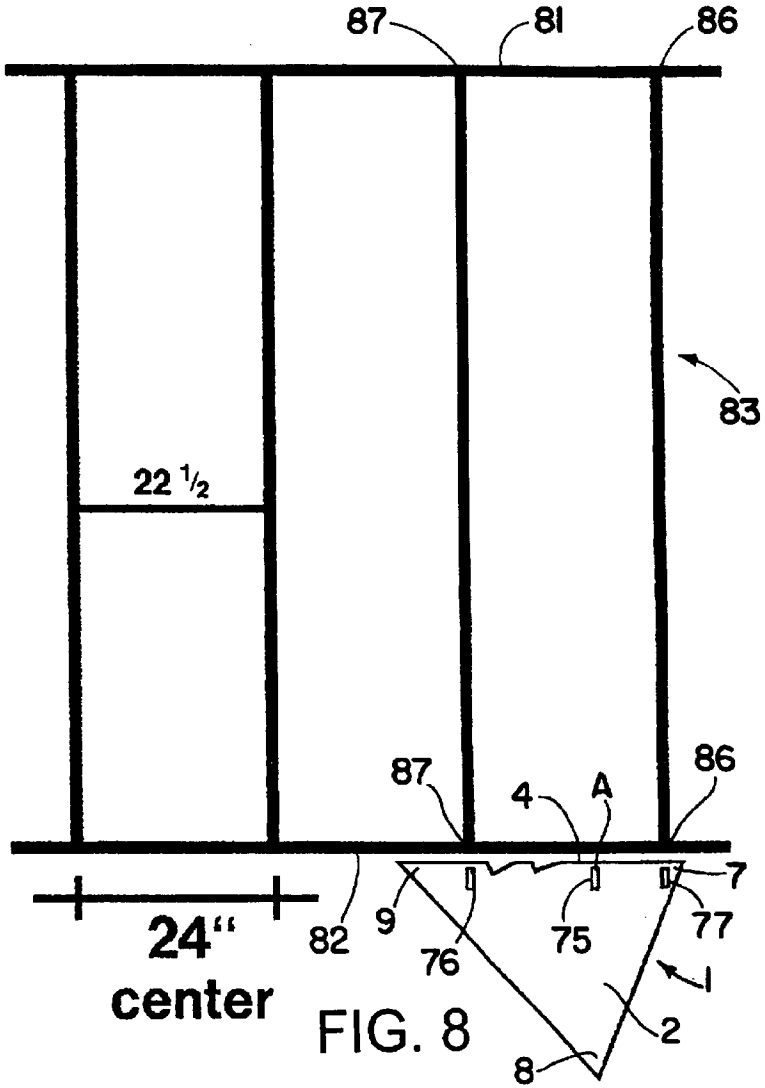
FIGS. 7 and 8 are schematic plan views showing the layout tool being used to make stud layouts on 16 inch and 24 inch centers, respectively.

Tool 1 can also be used to draw circles for example from 2 inches in diameter up to 54 inches in diameter in two inch increments by providing a pivot point hole 70 in the tool adjacent corner 7 and a plurality of incrementally spaced marker receiving holes 71 in the tool spaced for example in one inch increments from pivot point hole 70. Holes 70 and 71 are in a common plane in spaced parallel relation to side edge 4 of tool 1. To draw a circle of the desired diameter using tool 1, a screw or nail N is lightly fastened through the pivot point hole 70 onto a surface of the actual project or on a desired material for a pattern as schematically shown in FIG. 6. Next a pencil or other marker is inserted into one of the incremental holes 71 and used to rotate the tool in a circular motion creating the exact circle needed, for example a 20 inch diameter circle CR using the incremental hole 71 spaced 10 inches from the pivot point hole 70 as schematically shown in FIG. 6.

A plurality of spaced apart stud layout slots may also be provided in tool 1 for making different stud layouts for framed walls. In the embodiment shown in FIG. 1, three spaced apart parallel stud layout slots 75, 76 and 77 are provided in tool 1 extending perpendicular to and in closely spaced relation to side edge 4 of the tool. One of the stud layout slots 75 is desirably in alignment with notch A and 90° angle slot 37 so it can also be used in laying out 90° angles on smaller work pieces. Moreover, additional angle slots, for example, 22½°, 45° and 67½° angle slots 78, 79 and 80 may be provided in tool 1 in closely spaced relation to notch A and in radial alignment with notch A and the corresponding angle slots 38, 28 and 39 adjacent side edge 5 of tool 1 for use in laying out these angles on smaller work pieces.

The other two stud layout slots 76 and 77 are spaced in opposite directions from intermediate stud layout slot 75. Stud layout slot 76 may be spaced, for example, 16 inches from intermediate stud layout slot 75, whereas stud layout slot 77 may be spaced for example 8 inches from stud layout slot 75 and 24 inches from stud layout slot 76.

Figure 7:
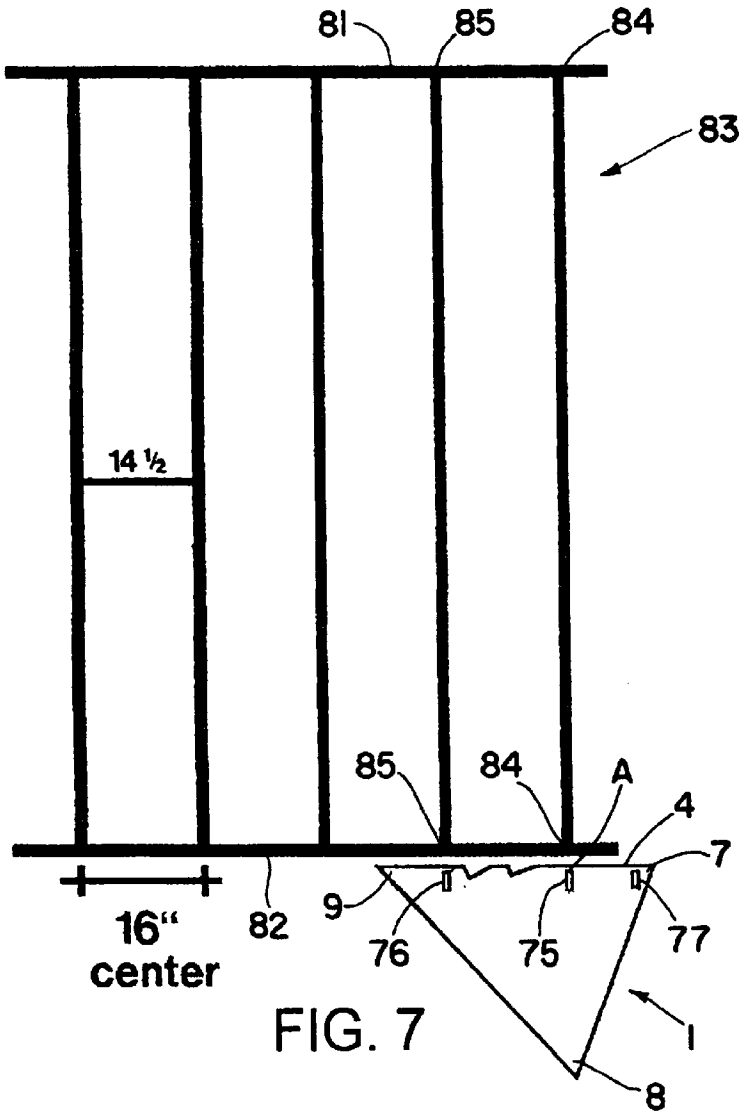

To lay out studs with 16 inch centers, for example, the top and bottom wall plates 81 and 82 for a framed wall 83 are first marked at 84 using the intermediate stud layout slot 75 as schematically shown in FIG. 7. Then the top and bottom wall plates 81 and 82 are marked at 85 using the stud layout slot 76 which is located 16 inches from and parallel to the stud layout slot 75. Next the tool 1 is moved along the wall plates 81 and 82 to line up the stud layout slot 75 (or notch "A" in alignment therewith) with the second mark 85, and a new mark is made in the 16 inch center slot 76, repeating this process all along the wall plates 81 and 82.

For a 24 inch center stud layout, the top and bottom wall plates 81 and 82 are marked at 86 using the slot 77, which is located 8 inches from the slot 75 and 24 inches from the slot 76. Then the slot 76 is marked at 87. Next the tool 1 is moved along the wall plates 81 and 82, lining up the 24 inch center slot 77 with the second mark 87 and repeating the process. Most carpenters would place an "X" to the right of each pencil mark, indicating the actual location for the stud.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A combination layout tool comprising a triangular shaped member having three side edges that intersect at opposite ends to form three angle corners, one of said side edges extending between two of said corners having a notch in said one side edge that is closer to one of said two corners than the other of said two corners, and a plurality of laterally spaced apart elongated incremental angle slots in said member adjacent the side edge of said member opposite said one corner that extend in a direction in radial alignment with said notch in said one side edge, said member having two 67½° angle corners and one 45° angle corner, said one side edge extending between said 45° angle corner and one of said 67½° angle corners, and said notch in said one side edge being closer to said one 67½° angle corner than the intersection of a line extending perpendicular from the other of said 67½° angle corners with said one side edge.

2. The tool of claim 1 wherein one of said incremental angle slots is a 90° angle slot that extends in a direction perpendicular to said one side edge in alignment with said notch.

3. The tool of claim 1 wherein said incremental angle slots are spaced 5° apart, further comprising at least one additional elongated angle slot between said 5° angle slots that extends in a direction in radial alignment with said notch in said one side edge.

4. The tool of claim 3 wherein an additional elongated angle slot is at 22½° as measured from said notch in a direction away from said one side edge, said additional elongated angle slot extending in a direction in radial alignment with said notch in said one side edge.

5. The tool of claim 3 wherein an additional elongated angle slot is at 67½° as measured from said notch in a direction away from said one side edge, said additional elongated angle slot extending in a direction in radial alignment with said notch in said one side edge.

6. The tool of claim 1 further comprising a triangular shaped slot in said member in close proximity to said notch having an acute angle corner facing said notch for latching one end of a string in said acute angle corner of said triangular shaped slot that has been pulled over said notch and one of said angle slots and through said triangular shaped slot.

7. The tool of claim 1 further comprising a pivot point receiving hole in said member adjacent one of said corners and a plurality of incrementally spaced marker receiving holes in said member in incremental spaced relation from said pivot point hole for drawing different diameter circles by rotating said tool about a pivot point extending through said pivot point hole using a marker extending through one of said marker receiving holes, said pivot point receiving hole and said marker receiving holes being in a common plane in parallel spaced relation to said one side edge.

8. A combination layout tool comprising a triangular shaped member having three side edges that intersect at opposite ends to form three angle corners, one of said side edges extending between two of said corners having a notch in said one side edge that is closer to one of said two corners than the other of said two corners, a plurality of laterally spaced apart elongated incremental angle slots in said member adjacent the side edge of said member opposite said one corner which terminate in spaced relation from the side edge opposite said one corner and extend in a direction in radial alignment with said notch in said one side edge, said slots having straight sides uniformly spaced apart throughout their length, and at least one rafter tail/ridge cut pattern formed in said one side edge in spaced relation from said notch, said pattern comprising two straight sides intersecting said one side edge and intersecting one another at 90°, one of said sides being shorter than the other side.

9. The tool of claim 8 wherein there are at least two rafter tail/ridge cut patterns formed in said one side edge in spaced relation from one another and from said notch, each of said patterns comprising two straight sides intersecting said one side edge and intersecting one another at 90°, one of said sides of each of said patterns being shorter than the other side.

10. The tool of claim 9 wherein one of said patterns is a 4 and 12 pitch pattern, and another of said patterns is a 6 and 12 pitch pattern.

11. A combination layout tool comprising a triangular shaped member having three side edges that intersect at opposite ends to form three angle corners, one of said side edges extending between two of said corners having a notch in said one side edge that is closer to one of said two corners than the other of said two corners, a plurality of laterally spaced apart elongated incremental angle slots in said member adjacent the side edge of said member opposite said one corner that extend in a direction in radial alignment with said notch in said one side edge, and at least two rafter tail/ridge cut patterns formed in said one side edge in spaced relation from one another and from said notch, each of said patterns comprising two straight sides intersecting said one side edge and intersecting one another at a 90° angle, one of said sides of each of said patterns being shorter than the other side, and elongated angled slots in said member that extend in a direction in alignment with the respective short side of each of said patterns.

12. A combination layout tool comprising a triangular shaped member having three side edges that intersect at opposite ends to form three angle corners, one of said side edges extending between two of said corners having a notch in said one side edge that is closer to one of said two corners than the other of said two corners, a plurality of laterally spaced apart elongated incremental angle slots in said member adjacent the side edge of said member opposite said one corner that extend in a direction in radial alignment with said notch in said one side edge, and tread and riser slots in said member extending at 90° relative to one another, said tread and riser slots having inner ends terminating in closely spaced relation from one another, and outer ends terminating in a plane parallel to said one side edge.

13. The tool of claim 12 wherein said tread slot has a length of 10 inches and said riser slot has a length of 7 inches.

14. The tool of claim 12 further comprising a hole in said member in the same plane in which the outer ends of said tread and riser slots terminate, said hole being spaced from said outer end of said riser slot a distance corresponding to the distance between the outer ends of said tread and riser slots.

15. A combination layout tool comprising a triangular shaped member having three side edges that intersect at opposite ends to form three angle corners, one of said side edges extending between two of said corners having a notch in said one side edge that is closer to one of said two corners than the other of said two corners, and a plurality of laterally spaced apart elongated incremental angle slots in said member adjacent the side edge of said member opposite said one corner that extend in a direction in radial alignment with said notch in said one side edge, and a plurality of elongated spaced apart parallel stud layout slots in said member extending in a direction perpendicular to said one side edge.

16. The tool of claim 15 wherein one of said stud layout slots is in alignment with said notch.

17. The tool of claim 16 wherein another of said stud layout slots is spaced 16 inches from said one stud layout slot for use of said stud layout slots to make a 16 inch stud layout.

18. The tool of claim 16 wherein there are two additional stud layout slots located on opposite sides of said one stud layout slot.

19. The tool of claim 18 wherein one of said additional stud layout slots is spaced 16 inches from one side of said one stud layout slot, and the other of said additional stud layout slots is spaced 8 inches from another side of said one stud layout slot for use of said one stud layout slot and said one additional stud layout slot in laying out studs on 16 inch centers, and for use of both of said additional stud layout slots in laying out studs on 24 inch centers.

20. A combination layout tool comprising a triangular shaped member having three side edges that intersect at opposite ends to form three angle corners, tread and riser slots in said member extending at 90° relative to one another, said tread and riser slots having inner ends terminating in closely spaced relation from one another, and outer ends terminating in a plane parallel to one of said side edges, and a hole in said member in the same plane in which the outer ends of said tread and riser slots terminate, said hole being spaced from said outer end of said riser slot a distance corresponding to the distance between the outer ends of said tread and riser slots.

* * * * *